United States Patent [19]

van Mil

[11] 4,147,012

[45] Apr. 3, 1979

[54] METHOD AND APPARATUS FOR PACKING SLAUGHTERED BIRDS, INCLUDING POULTRY, INTO AN ENVELOPE, ESPECIALLY A BAG SHAPED PACKAGE

[75] Inventor: Martinus P. G. van Mil, Boxmeer, Netherlands

[73] Assignee: Stork PMT B.V., Boxmeer, Netherlands

[21] Appl. No.: 882,981

[22] Filed: Mar. 3, 1978

[30] Foreign Application Priority Data

Mar. 10, 1977 [NL] Netherlands ..... 7702628

[51] Int. Cl.[2] ..... B65B 43/26

[52] U.S. Cl. ..... 53/468; 53/258; 53/469; 53/572

[58] Field of Search ..... 53/468, 469, 572, 570, 53/258, 261

[56] References Cited

U.S. PATENT DOCUMENTS

| | | | |
|---|---|---|---|
| 3,971,191 | 7/1976 | Hoyland | 53/258 X |
| 4,033,088 | 7/1977 | Markert | 53/572 X |

*Primary Examiner*—Travis S. McGehee

*Attorney, Agent, or Firm*—Edmund M. Jaskiewicz

[57] ABSTRACT

A method of mechanically packing a slaughtered bird, including poultry, comprising opening an inlet of an envelope resting on a support, pushing a bird resting with stretched legs on a support into the envelope by exercising a force on the body of the bird, then pressing the legs upwardly to locate the legs in a folded position on both sides of the body and thereafter sealing the envelope.

16 Claims, 8 Drawing Figures

METHOD AND APPARATUS FOR PACKING SLAUGHTERED BIRDS, INCLUDING POULTRY, INTO AN ENVELOPE, ESPECIALLY A BAG SHAPED PACKAGE

BACKGROUND OF THE INVENTION

The present invention relates to a method of, and an apparatus suitable for use in, packing slaughtered birds, including poultry, into an envelope, especially a bag or a bag shaped package, to be sealed after filling.

In a method which has been proposed for the mechanical packing of poultry to be frozen, the legs of the poultry are folded against the bird after which the whole bird is pressed into a package and the package is sealed behind the legs. An apparatus for carrying out this method has been proposed and is based on the same principle; that is: first the legs are folded or bent up and then the body is pushed into the package.

It will be appreciated that, when packing birds, for example poultry, in a folded configuration, spare room must be allowed so that the birds can be inserted in the bags with the bags reliably not being split. This is, of course, disadvantageous when the birds are to be frozen, it being well-known that as small a bag as possible should be used for freezing, so that the likelihood of ice-burning can be reduced.

SUMMARY OF THE INVENTION

It is an object of the present invention to provide a method and apparatus which can be used to help alleviate the aforementioned difficulties.

According to a first aspect of the present invention there is provided a method of mechanically packing a slaughtered bird, including poultry, which method comprises inserting a bird having extended legs into an envelope, thereafter folding the legs and sealing the envelope.

In accordance with a preferred embodiment of the first aspect there is provided a method of mechanically packing a slaughtered bird, including poultry which method comprises opening an inlet of an envelope, such as a bag, resting on a support, pushing a bird resting with stretched legs on a support into the envelope by exercising a force on the body of the bird, then pressing the legs upwardly to locate the legs in a folded position on both sides of the body and thereafter sealing the envelope.

According to a second aspect of the present invention there is provided an apparatus suitable for use in packing a slaughtered bird, including poultry, which apparatus comprises means for retaining an inlet of an envelope in an open position, means for inserting a bird into the envelope through the inlet, means for folding the legs of the bird when the bird is in the envelope and means for sealing the envelope.

In accordance with a preferred embodiment of the second aspect there is provided an apparatus suitable for use in packing a slaughtered bird, including poultry, which apparatus comprises means for acting upon the inner surface of an inlet of an envelope, such as a bag, for keeping the inlet of the envelope open, means for supporting the envelope and the bird, first reciprocable pusher means movable in a direction toward and into the envelope through the inlet for pushing the bird into the envelope through the inlet, second reciprocable pusher means movable in a forward direction toward and into the envelope through an inlet for acting on the legs of the bird when positioned in the envelope to fold the legs of the bird, drive means for the first and second pusher means, the drive means being such that first the first pusher means and then the second pusher means can act in use on the bird whilst moving in the forward direction, toward the inlet and means for sealing the envelope, having the birds positioned, in use, therein.

The present invention enables the provisions of an apparatus and method in which a bird, such as poultry, within ample limits independent of its dimensions, can be packed in such a manner that a compact whole is obtained in which the envelope, such as a bag or package encloses the bird narrowly that is the bird can be closely encased in the envelope.

In a preferred embodiment of a method in accordance with the present invention, the inlet of a bag resting on a support is opened and the bird resting with its back on an adjoining support, is pushed into the bag with extended legs, the legs are thereafter pressed up till they are in a folded position on both sides of the body, and subsequently the bag is sealed behind the legs.

Advantageously, a bow-shaped member extends across the bird at the upper part of the legs thereof partly to encircle the bird whilst the bird is inserted into the envelope. The legs of the bird are preferably retained in the folded or pushed up position before the envelope is sealed.

A method in accordance with the present invention can be very easily carried out mechanically, can result in a very compactly packed bird, the envelope encasing the body very narrowly.

One embodiment of an apparatus in accordance with the present invention comprises elements acting upon the inner surface of an inlet of a bag for keeping open the inlet; elements movable through them for pushing the bird into the bag, a support for both the bag and the bird, a first pushing element movable in the direction of the opening of the bag and backward for pushing up the body of the bird, a second pushing element also movable in the direction of the opening of the bag and backward for working on the ends of the legs, drive means for the first and second pushing elements respectively, the drive means being such that, in use, first the first pushing element and then the second pushing element is pressed in a direction toward the opening of the bag and elements for sealing the bag behind the legs.

Advantageously, the apparatus comprises a bow-shaped member for extending across the bird at the upper part of the legs thereof partly to encircle the bird whilst the bird is pushed, in use, into the envelope.

A preferred embodiment of an apparatus in accordance with the present invention can have a number of main operating elements, the movement of which is rectilinear and the various movement of which can be derived from each other. Such a preferred apparatus can be of simple construction and may reach a very high rate of production. Advantageously, correct positioning of the bird in the envelope is facilitated by positioning the bird by means of the bow-shaped member which partly encircles or encloses in use, the bird with respect to the envelope and then pushing the legs upwards by means of a bow-shaped pushing means.

Preferably the first pusher means is coupled with a pair of tongs having jaws movable with respect to each other. This first pusher means may comprise or be formed by, a pressing edge extending, in use, over the tail of the bird.

The coupling or combination of the first pusher means with the pair of tongs has the advantage of facilitating operational placing of the bird in the apparatus, that is placing of the bird between the jaws. The pressing edge is a suitable element for exercising force on the bird in a longitudinal direction.

A preferred embodiment of an apparatus in accordance with the present invention comprises means attached to a bearer or carrier for retaining the legs in the folded or pushed up position. Advantageously the means comprises a flexible element. This element preferably fixes or retains in use, the legs and spans the envelope rigidly over the legs while the envelope is being sealed.

The means for acting upon the inner surface of the inlet advantageously comprises members through which the first pusher means can move, the members consisting of two, preferably oblong, longitudinal funnel portions positioned opposite each other and movable in a longitudinal direction, ends of the portions directed toward the inlet of the open envelope being guided, in use, such that the ends, whilst moving, in use, from a starting position, toward the envelope, can also move away from each other to a final position in which the ends extend, in use, into the envelope and clasp the envelope against stops. Advantageously, the bow-shaped member extends, in use, into the envelope and is attached to a pivot arm. The drive for the pivot arm is preferably synchronised with that of the funnel portions such that, in use, forward movement of the funnel portions causes upward movement of the pivot arm, and inversely, that is backward movement of the funnel portions causes downward movement of the pivot arm.

Advantageously, the means for supporting the bird and envelope during packing comprises three, aligned corresponding portions, the portions being a first support, such as a first supporting table located below the pair of tongs and the first pusher means, a second support, such as a second supporting table, preferably comprising a horizontal portion and a downwardly directed portion, for supporting a stack of the envelope and a third discharge support, such as a third discharge table, which can be pivoted away from the second support. Advantageously, the height of the second support is adjustable such that the upper face of the stack of envelopes situated, in use, on the second support can adjoin the supporting surface of the first support.

The bearer for the flexible element is preferably fastened to the third discharge support.

SURVEY OF THE DRAWINGS

FIGS. 1, 2 and 3, each show schematically a side view of an embodiment of an apparatus in accordance with the present invention in sequential stages of inserting a bird in a bag, one of the funnel portions being omitted, for reasons of clarity, from FIGS. 2 and 3, FIG. 4 shows an enlarged bottom view of the bearer and tongs member of the embodiment apparatus of FIG. 1, FIG. 5 shows a part-sectional side view on an enlarged scale of the carriage part of the apparatus, the various members of the part being in the same relative positions as shown in FIG. 1, and FIGS. 6, 7 and 8 each show in detail and on an enlarged scale a side view of the bag supporting part of the embodiment apparatus in sequential stages of sealing a bag having the bird positioned therein and ejection of the sealed bag from the apparatus.

DESCRIPTION OF PREFERRED EMBODIMENTS

Figure 1:
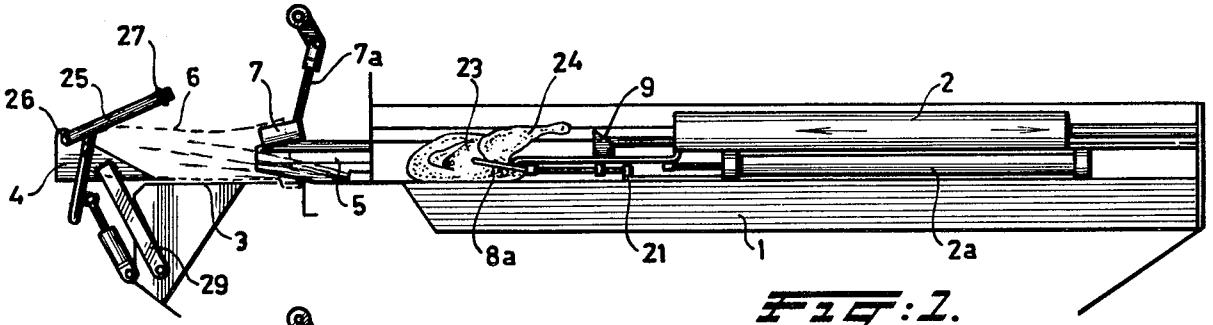

Various parts of the apparatus shown in the Figures are illustrated schematically only and drive means for the various parts which is preferably pneumatic but may be hydraulic or electric, will not be explicitly described.

Referring to the drawings, the embodiment apparatus comprises three longitudinally aligned supports namely a first support table 1 having a reciprocably movable sledge or carriage 2 driven by a pneumatic cylinder **2*a*, a corresponding second support 3 for supporting the bags in which the poultry is to be packed, and a corresponding pivotal discharge table 4** which can pivot or tip to the left as shown in the drawings.

The table 1 also supports two longitudinal upright preferably oblong, portions or plates 5, (one of which is clearly visible in FIG. 1) positioned opposite each other and to form therebetween a funnel for keeping open the inlet end of a bag 6. The funnel plates 5 are guided and driven such that, as the funnel plates 5 move forward the foremost edges or front ends of the funnel plates diverge to keep the bag 6 open.

In a preferred embodiment, the funnel plates 5 are movable in a longitudinal direction by drive means which cause the plates 5 to move from a starting position toward the bag. During this movement, the ends of the plates 5 directed toward the inlet end of the open bag are guided in such a way that they diverge, that is move away from each other, to a final position wherein the ends extend into the bag and clasp the bag against stops.

A bow 7 connected to a pivot arm **7*a* and coupled to the drive means for the funnel plates 5 performs the double function of keeping the bag 6** open and of guiding the breast side, that is the breast and legs of the poultry.

In a preferred embodiment, the bow 7 is coupled to drive means for the funnel plates 5 such that forward movement of the plates 5 causes the bow 7 to extend into the open end of the bag 6 and the pivot arm **7*a* to move upwardly. Avantageously, backward movement of the plates 5, that is movement away from the closed end of bag 6, causes the bow 7 to leave the bag and the pivot arm 7*a*** to move downwardly.

Figure 2:
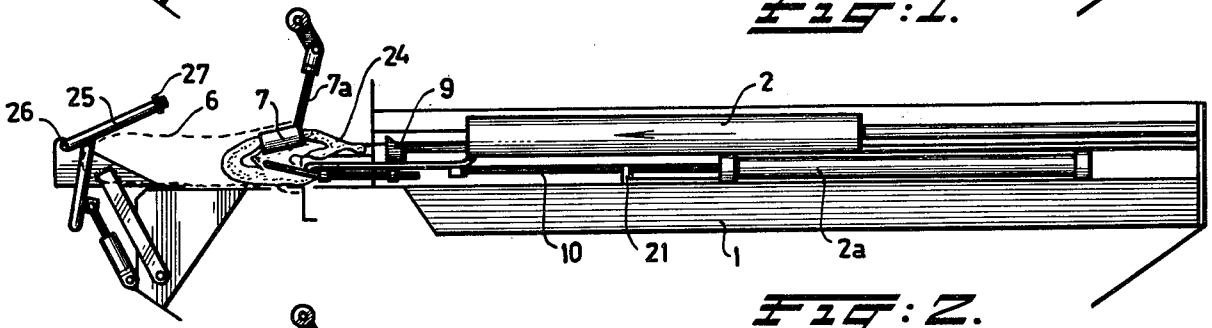
Figure 3:
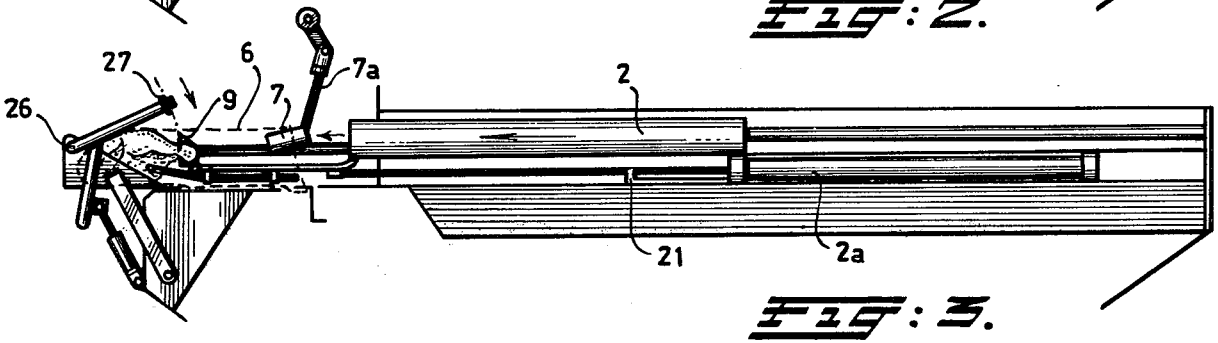
Figure 6:
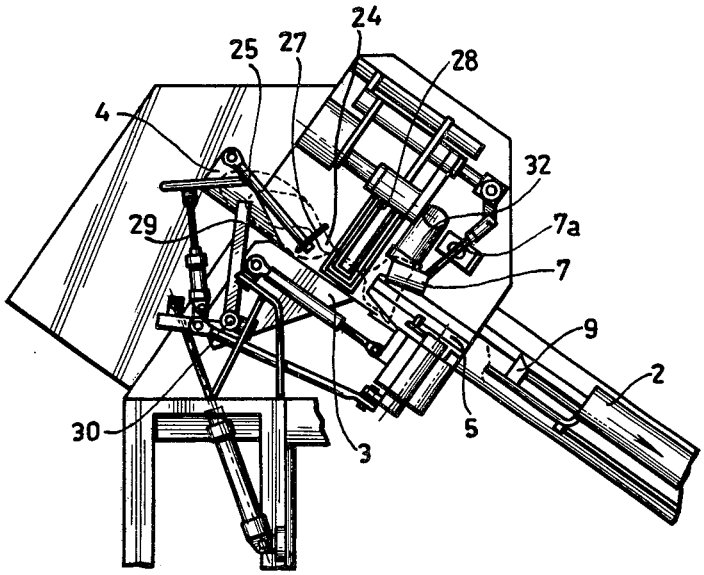
Figure 7:
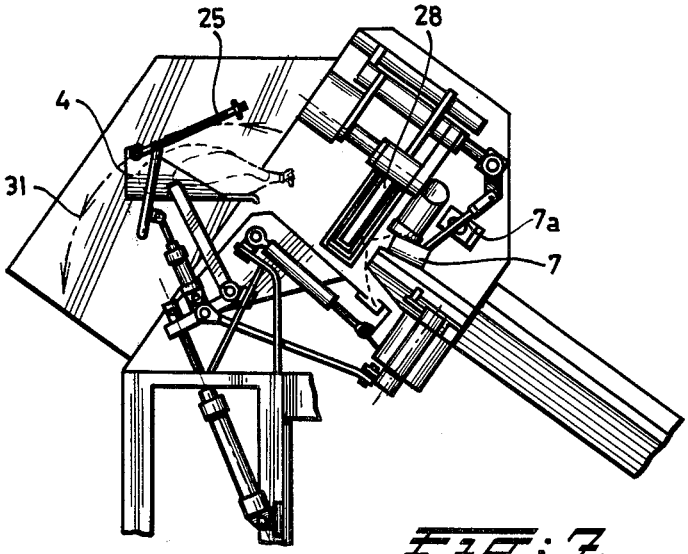
Figure 8:
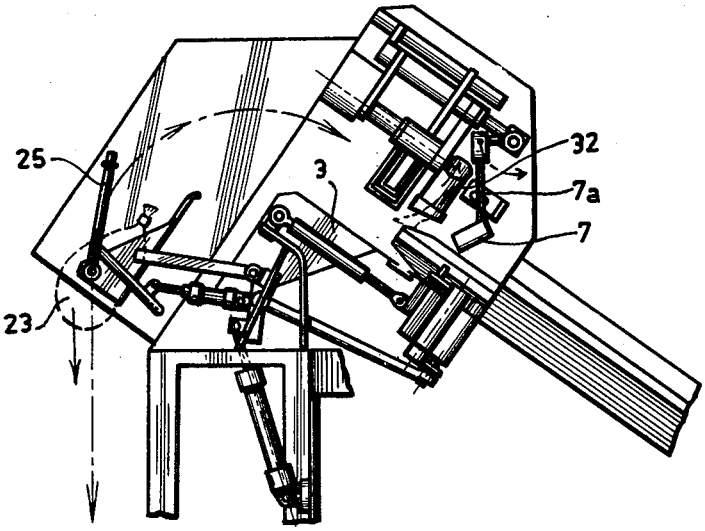

Although the supports are shown in FIGS. 1 to 3 to the horizontal, in actual practice the supports are inclined to the horizontal as shown in FIGS. 6 to 8.

Figure 4:
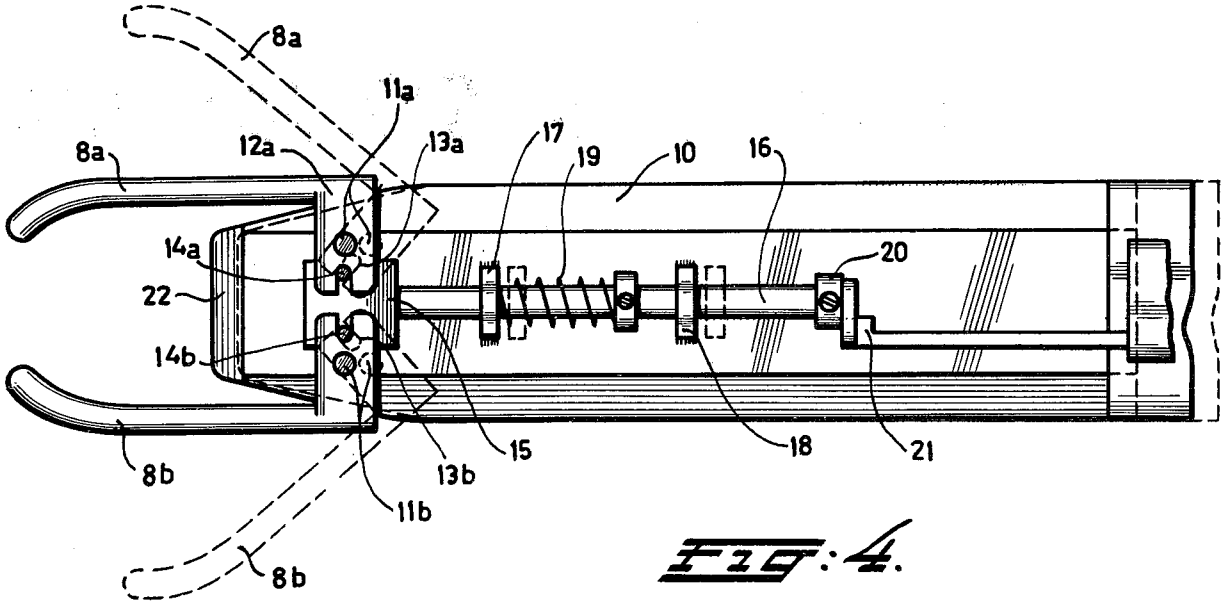
Figure 5:
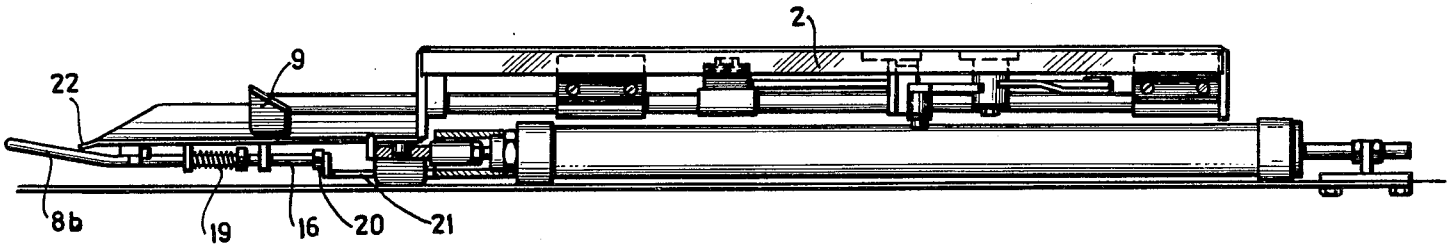

The carriage 2 is provided with a bearer or support member 10 to which arms **8*a* and 8*b* of a tongs member are attached. The support member 10 has, at the foreside, that is the free end, thereof, a pressure or pressing edge 22 the purpose of which will be explained hereinafter. The arms 8*a* and 8*b* of the tongs member have inwardly bent end portions 12*a* and 12*b* pivotally mounted to the support member 10 via fixed pivots 11*a* and 11*b*, respectively. The inner ends of bent end portions 12*a* and 12*b* have open slot holes 13*a* and 13*b* in which driving pins 14*a* and 14*b* fastened to a sliding member or piece 15 can engage. The sliding member 15 is carried by a rod 16 arranged in fixed bearings 17 and 18 connected to the support member 10. A fixed stop 21 is provided to contact an end 20 of the rod 16, when the rod 16 is in its furthermost position from the support 3. A spring 19 is arranged on the rod 16 and biased to press the rod 16 to the right so as to cause the arms 8*a* and 8*b* to move from the open or spread position shown in discontinuous lines in FIG. 4 to the closed position shown in continuous lines. Movement to the right of the support member 10 causes the end 20 of the rod 16 to contact the stop 21 (as shown in continuous lines in FIG. 4). Further movement to the right causes the arms 8***a* and 8*b* to open or spread (as shown in discontinuous lines in FIG. 4) and the spring to be compressed against its bias. Further movement to the left, that is toward the second support 3, causes the arms 8*a* and 8*b* to close aided by the bias of the spring 19.

The carriage 2 also bears at least one, preferably two, bowl-shaped pushing element 9. The drive for the tongs member and for the pushing element 9 is such that movement of the carriage 2 to the left causes first the arms 8*a* and 8*b* to move to the left and, after traversing a certain distance, the pushing element 9, originally positioned behind the arms 8*a* and 8*b*, overtakes the arms as shown in FIG. 3.

The discharge table 4 is located partly on the second support 3 so as to lie under the closed end portion of the bags 6. The discharge table 4 is connected to a support or arm 29 having at the free end thereof a fixed pivot point 30. Bow members or arms 25 are pivotally mounted on the discharge table 4 by means of fixed pivots 26.

The free ends of the bow members 25 are interconnected by a flexible element 27 such as string arranged transversely of the bow members 25 (as shown in FIG. 6). The bow members 25 can be pivoted downwardly by suitable drive means.

The operation of the apparatus will now be described.

The carriage 2 is, in the starting position thereof, located in its farthermost position from the second support 3, that is in its most right-hand position. As a result, due to the cooperation of the end 20 with the stop 21, the arms 8*a*, 8*b* of the tongs member are open, that is spread, as shown in discontinuous lines in FIG. 4. A bird 23 to be packed is manually placed between the arm 8*a*, 8*b*, the tail being arranged under the pressure edge 22 of the support member 10. Subsequently, the drive for the sledge 2, that is the cylinder 2*a*, is put into operation either manually or by means of a control which reacts to the placing of the bird, for example a photoelectric control, and as a result the carriage 2 commences its movement to the left. The arms 8*a*, 8*b* move toward each other as previously explained and enclose the poultry resiliently as shown in FIG. 1. The poultry, guided by the funnel plates 5 and the bow 7, is then pressed into the bag 6. FIG. 2 shows the bird 23 on arrival at the front part of the bag being guided on top by the bow 7, and on the sides by the funnel plates 5 and being pushed forward by the arms 8*a*, 8*b* and the pressure edge 22. The pushing element 9, however, is at the point about to rapidly overtake the arms 8*a*, 8*b* and the pressure edge 22, and, shortly after the situation shown in FIG. 2, that is while the bird is still located below the bow 7, the pushing element 9 overtakes the end of legs 24 of the bird 23. The legs are thereby pushed up and located in bent position along the body by the pushing element 9 shown in FIG. 3.

In order to seal the bag 6, both the arms 8*a*, 8*b* and the pushing element 9 should be moved back that is to the right, in order to be able to seal the bag directly behind the legs. When the bird is in the position shown in FIG. 3 the bow members 25 are pivoted downwardly to the position shown in FIG. 6 and, as a result, the string 27 encircling partly or enclosing the bag 6 is spanned around the legs of the bird and keeps the bird in position.

The various stages of sealing the bag and of discharging the bird from the apparatus are explained with reference to FIGS. 6 to 8.

A sealing mechanism 28 which may be any suitable known sealing mechanism, for example those utilising self-adhesive tape or fusion of a bag-shaped package, is illustrated in full in FIG. 6. Such a sealing mechanism is known per se and, therefore will not be discussed in further detail. FIG. 6 shows the situation in which the bag is sealed directly behind the end of the legs 24 of the bird still partly encircled by the flexible element 27, the bird resting on the discharge table 4. Under the action of various driving mechanisms shown in the drawings but not described in detail, and after the sealing of the bag by the sealing mechanism 28, the bow 25 is pivoted upwardly while the discharge table 4 begins to pivot or tip to the left about the fixed point 30 as indicated by the arrow 31 in FIG. 7. Finally, the situation shown in FIG. 8 is reached, that is the bird 23 falls from the discharge table 4 into a container (not shown) placed thereunder.

Of course, a packing apparatus constructed according to the bow-shaped can have a number of preferred provisions which, will not be discussed explicitly because they are not essential to the present invention. For example a nozzle 32, shown in FIGS. 6 to 8 can be provided for sucking off that part of the bag remaining after sealing. As shown in FIG. 6, this nozzle is closed by the bow 7 during sealing. When the discharge table 4 tips away the bow 7 is tipped sideways, or moved backwardly by a suitable command mechanism to release the nozzle. Furthermore, the support 3 for the bags can be provided with a suitable mechanism for always positioning the uppermost bag on the right level with respect to the funnel plates 5 and the funnel plates can be coupled with a suitable mechanism for displacing them forward and sideways in order to enclose a new bag blown open by means of a blower.

What is claimed is:

1. A method of mechanically packing a slaughtered bird, which method comprises, opening an inlet of an envelope resting on a support, pushing a bird resting with stretched legs on a support into the envelope by exercising a force on the body of the bird, then pressing the legs upwardly to locate the legs in a folded position on both sides of the body and thereafter sealing the envelope.

2. The method of claim 1, wherein a bow-shaped member extends across the bird at the upper part of the legs thereof partly to encircle the bird whilst the bird is inserted into the envelope.

3. The method of claim 1, wherein the legs are retained in the folded position before the envelope is sealed.

4. An apparatus suitable for use in packing a slaughtered bird, which apparatus comprises means for acting upon the inner surface of an inlet of an envelope for keeping the inlet of the envelope open, means for supporting the envelope and the bird, first reciprocable pusher means movable in a direction toward and into the envelopethrough the inlet for pushing the bird into the envelope through the inlet, second reciprocable pusher means movable in a forward direction toward and into the envelope through an inlet for acting on the legs of the bird when positioned in the envelope to fold the legs of the bird, drive means for the first and second pusher means, the drive means being such that first the first pusher means and then the second pusher means can act in use on the bird whilst moving in the forward direction, toward the inlet and means for sealing the envelope, having the bird positioned, in use, therein.

5. The apparatus of claim 4, which comprises a bow-shaaped member for extending across the bird at the upper part of the legs thereof partly to encircle the bird whilst the bird is pushed, in use, into the envelope.

6. The apparatus of claim 4, wherein the first pusher means is coupled with a pair of tongs having jaws movable with respect to each other.

7. An apparatus as defined in claim 6, wherein the jaws are movable with respect to each other in a substantially horizontal plane.

8. An apparatus as defined in claim 6, wherein the first pusher means comprises a pressure edge, for contacting the bird located behind, when looking in the forward direction, the jaws of the pair of tongs and extending, when contacting, in use, the bird over the tail of the bird.

9. The apparatus of claim 6, wherein the means for supporting the bird and the envelope comprises three aligned portions, the portions being a first support located below the pair of tongs and the first pusher means, a second support for supporting a stack of the envelopes and a third discharge support which can be pivoted away from the second support.

10. An apparatus as defined in claim 9, wherein the second support comprises a substantially horizontal portion and a downwardly incline portion.

11. The apparatus of claim 9, wherein the height of the second support is adjustable such that the upper face of the stack of envelopes situated, in use, on the second support can adjoin the supporting surface of the first support.

12. The apparatus of claim 4, which comprises means attached to a carrier for retaining the legs in the folded position.

13. An apparatus as defined in claim 12, wherein the retaining means comprises a flexible element.

14. An apparatus as defined in claim 9, wherein the bearer is connected to the third discharge support.

15. The apparatus of claim 4, wherein the means for acting upon the inner surface of the inlet comprises members through which the first pusher means can move, the members consisting of two oblong funnel portions situated opposite each other and movable in a longitudinal direction, ends of the portions directed toward the inlet being guided in use, such that the ends, whilst moving, in use, from a starting position, toward the envelope can also move away from each other to a final position in which the ends extend, in use, in the envelope and clasp the envelope against stops.

16. The apparatus of claim 5, wherein the bow-shaped member extends, in use, into the envelope and is attached to a pivot arm and wherein the drive for the pivot arm is synchronised with a drive for the funnel portions such that, in use, forward movement of the funnel portions toward the inlet causes an upward movement of the pivot arm and inversely.

* * * * *